United States Patent [19]

Burlison

[11] Patent Number: 5,009,010

[45] Date of Patent: Apr. 23, 1991

[54] AXE HEAD MOUNTED HANDLE PROTECTOR

[76] Inventor: Gary L. Burlison, 31909 S.E. Green River Gorge Rd., Black Diamond, Wash. 98010-7529

[21] Appl. No.: 524,987

[22] Filed: May 18, 1990

[51] Int. Cl.[5] ..... B26B 23/00; B25G 3/20

[52] U.S. Cl. ..... 30/308.1; 30/308.3

[58] Field of Search ..... 30/308.1, 308.2, 308.3, 30/308, 318

[56] References Cited

U.S. PATENT DOCUMENTS

| | | | |
|---|---|---|---|
| 428,528 | 5/1890 | Schoettle . | |
| 489,511 | 1/1893 | Terpening . | |
| 776,734 | 12/1904 | Fuller . | |
| 1,111,277 | 9/1914 | Trainor | 30/308.1 |
| 1,206,695 | 11/1916 | Greenwood . | |
| 1,259,161 | 3/1918 | Suer . | |
| 1,643,861 | 9/1927 | Szakacs | 30/308.1 |
| 2,738,815 | 3/1956 | Hoeldtke . | |
| 4,139,930 | 2/1979 | Cox | 30/308.1 |
| 4,181,166 | 1/1980 | Jones . | |
| 4,199,016 | 4/1980 | Eads et al. | 30/308.3 |
| 4,352,381 | 10/1982 | Provi | 30/308.1 |

FOREIGN PATENT DOCUMENTS

| | | | |
|---|---|---|---|
| 137785 | 1/1962 | U.S.S.R. | 30/308.3 |

*Primary Examiner*—Douglas D. Watts
*Assistant Examiner*—Paul M. Heyrana
*Attorney, Agent, or Firm*—Fleit, Jacobson, Cohn, Price, Holman & Stern

[57] ABSTRACT

An axe handle protector is provided for an axe (wood splitting) including a rigid arm supported and projecting rearwardly from the rear side of the axe head in closely spaced relation beneath the handle of the axe and a resilient spacing and bracing body is disposed between the rear end of the arm and the opposing underside portion of the axe handle.

11 Claims, 1 Drawing Sheet

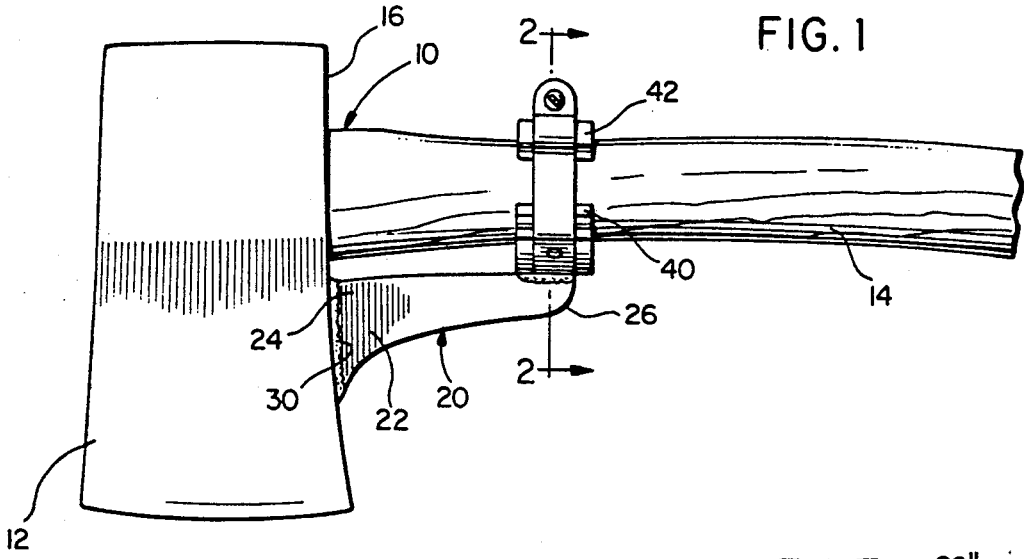
FIG. 1
FIG. 2
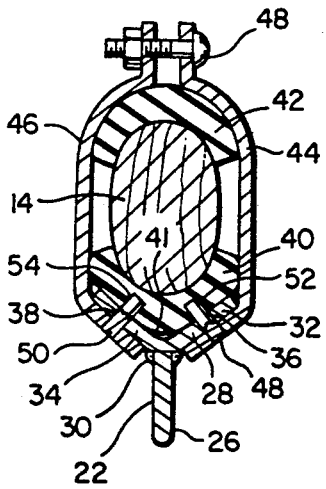
FIG. 3
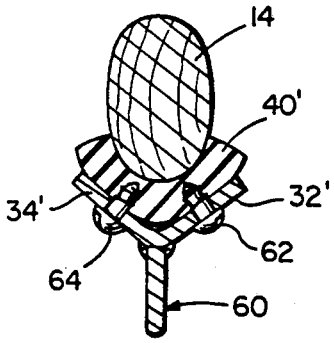
FIG. 7
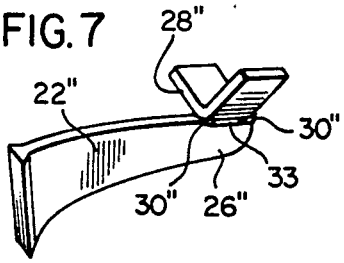
FIG. 6
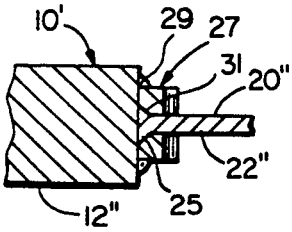
FIG. 5
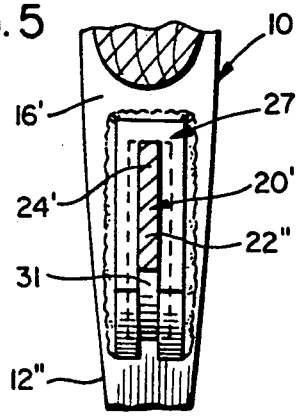
FIG. 4
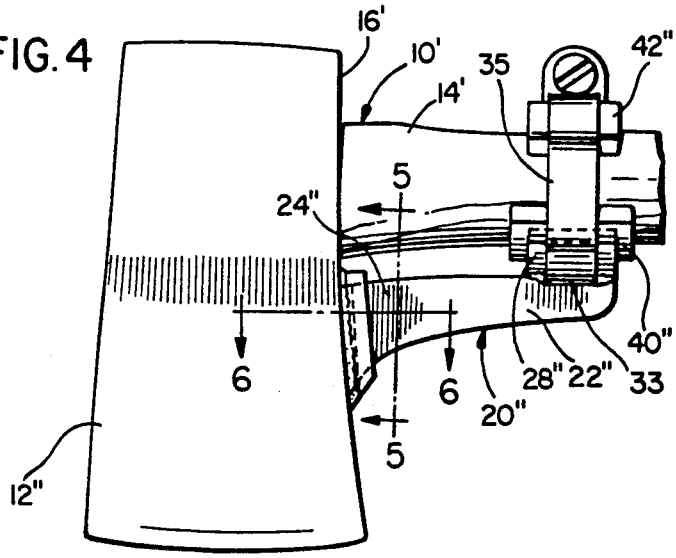

AXE HEAD MOUNTED HANDLE PROTECTOR

BACKGROUND OF THE INVENTION

1. Field of the Invention

This invention relates to a rigid protective arm which is supported and extends rearwardly from an axe head beneath the corresponding axe handle in closely spaced relation relative thereto and which includes a resilient spacing and bracing member between the rear end of the arm and the opposing underside portion of the axe handle.

2. Description of Related Art

Various different forms of axe handle protectors heretofore have been provided such as those disclosed in U.S. Pat. Nos. 428,528, 438,990, 489,511, 776,734, 1,206,695, 1,259,161, 2,738,815 and 4,181,166. However, these previously known forms of axe handle protectors do not include structure by which the user of an axe handle protector equipped axe is protected against the transmission of severe vibrational energy to his hands from an axe handle in the event the user contacts a log section being split with the axe handle protector.

SUMMARY OF THE INVENTION

The axe handle protector of the instant invention is supported from an axe head and extends rearwardly therefrom beneath the associated axe handle in spaced relation relative thereto and the rear end of the protector is cushion braced relative to the axe handle portion disposed immediately thereabove. Various different methods are provided for securing the axe handle protector to the axe head and for cushion bracing the rear end of the handle protector relative to the axe handle.

The main object of this invention is to provide an axe handle protector carried by an axe head and cushioned, at its rear end, relative to the underside of the associated axe handle in a manner such that contact of the axe handle protector with a work piece such as a log being split will not transmit severe vibrational forces to the axe handle.

Another object of this invention is to provide an axe handle protector concept in accordance with the preceding objects and which may incorporate different manners of mounting the axe handle protector from the axe head.

Another object of this invention is to provide an axe handle protector which may incorporate one of several different manners of cushioned bracing the handle protector relative to the axe handle.

Another very important object of this invention is to provide an axe handle protector incorporating an axe head to which an axe handle protector may be added as an after market attachment, if desired.

A final object of this invention to be specifically enumerated herein is to provide an axe handle protector in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary side elevational view of a typical form of axe equipped with an axe handle protector constructed in accordance with the present invention;

FIG. 2 is an enlarged fragmentary vertical sectional view taken substantially upon the plane indicated by the section line 2—2 of FIG. 1;

FIG. 3 is a vertical sectional view similar to FIG. 2 but illustrating a different manner of maintaining a cushioning member in position between the axe handle protector and the associated axe handle;

FIG. 4 is a fragmentary side elevational view similar to FIG. 1 but illustrating a second form of axe head protector removably supported from the associated axe head;

FIG. 5 is an enlarged fragmentary vertical sectional view taken substantially upon the plane indicated by the section line 5—5 of FIG. 4;

FIG. 6 is a fragmentary horizontal sectional view taken substantially upon the plane indicated by the section line 6—6 of FIG. 4; and FIG. 7 is a perspective view of the removable arm portion of the axe head protector illustrated in FIGS. 4–6.

DESCRIPTION OF THE PREFERRED EMBODIMENTS

Referring now more specifically to the drawings the numeral 10 generally designates a conventional form of axe including an axe head 12 and a handle 14 projecting rearwardly from the rear side 16 of the head 12.

The axe head mounted handle protector of the instant invention includes a first form referred to in general by the reference numeral 20 and incorporating an impact protecting arm 22 including front and rear ends 24 and 26.

The front end 24 is secured, by welding 30, to the rear side 16 of the head 12 and the arm 22 extends rearwardly from the head 12 beneath the handle 14. The rear end 26 of the arm 22 includes an upwardly opening V-shaped mount 28 supported therefrom by welding 30 and the mount 28 includes upwardly divergent opposite side arms 32 and 34 having apertures 36 and 38 formed therethrough. The mount 28 defines an upwardly opening seat 41 in which a resilient bracing and spacing block 40 is seated with the block 40 at least slightly compressed between the seat 41 and the handle 14.

An upper resilient block 42 is disposed over the handle 14 and a pair of vertical clamp straps are provided and are adjustably secured together at their upper ends by a clamp screw 48, the lower ends of the straps 44 and 46 including anchor and indexing pins 48 and 50 snugly received through the apertures 36 and 38 and seated in blind bores 52 and 54 formed in the block 40. Consequently, the clamp straps 44 and 46 clamp the blocks 40 and 42 to the handle 14 and the block 40 comprises a spacing and bracing block whereby proper spacing between the arm 22 and the handle 14 thereabove is maintained. In addition, the blocks 40 and 42, and especially the block 40, prevent vibration of the arm 22 being transmitted directly to the handle 14 in the event the arm 22 strikes an object on the down swing of the head 12 of the axe 10.

With reference now more specifically to FIG. 3 of the drawings there may be seen a modified form of protector referred in general by the reference 60 and which is substantially identical to the protector 20, except that the upper block 42, clamp straps 44 and 46 and clamp screw 48 are eliminated. However, the protector 60 includes a spacing and bracing block 40' corresponding to the block 40, but the block 40' is held in position through the utilization of removable indexing and attaching screws 62 and 64 secured through the arms 32' and 34' corresponding to the arms 32 and 34.

With reference now more specifically to FIG. 4 of the drawings, an axe 10' is illustrated including a axe handle protector referred to in general by the reference 20''. The protector 20'' includes an arm 22'' whose forward end is provided with a dovetail enlargement 25 and the rear side 16' of the axe head 12' has guideway structure referred to in general by the reference numeral 27 secured thereto by the welding 29, the guideway structure defining a downwardly opening dovetail guideway 31 in which to receive the dovetail enlargement 25. In this manner, the arm 22'' is supported from the axe head 12''. The rear end 26'' has an upwardly opening V-shaped mount 28'' corresponding to the mount 28 secured thereto by welding 30'' and the upper edge of the rear end of the arm 22'' is notched as at 33 beneath the mount 28'' in order to form a slot through which to receive a clamp strap 35. A block 40'' corresponding to the block 40 is supported from the mount 28'' and is utilized not only to maintain the front end 24'' of the arm 22'' in its uppermost position in the guide way 31, but also to clamp the mount 28'' and the block 40'' relative to the handle 14'. Also, an upper block 42'' corresponding to the block 42 is disposed between the adjustable length clamp strap 35 and the upper portion of the handle 14'.

The underside of the block 40'' is grooved to receive the mount 28'' therein, whereby the block 40'' is retained in correct position relative to the mount 28''. In addition, the upper block 42'' also may be notched to receive the clamp strap 35 therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wood splitting implement for splitting log sections into firewood, said implement including an elongated horizontal handle having front and rear ends, a downwardly facing splitting head mounted on said front end, said head including a rear side projecting above and below said handle, a rigid arm rigidly supported from said rear side of said head, at an elevation spaced below said handle, against upward displacement relative to said head and projecting rearwardly from said rear side beneath said handle in closely spaced relation relative thereto, and resilient spacing and bracing body means spaced rearward of said rear side and interposed between the rear end of said arm and the opposing underside portion of said handle.

2. The implement of claim 1 wherein the rear end of said arm includes seat means defining an upwardly opening seat, said spacing and bracing body being seated in said seat.

3. The implement of claim 1 wherein the rear end of said arm and said spacing and bracing body means include coacting indexing means removably anchoring said spacing and bracing body relative to said arm against shifting relative thereto.

4. The splitting implement of claim 3 wherein said indexing means includes shank type fasteners removably supported from said arm and releasably engaged with said spacing and bracing body.

5. The implement of claim 3 wherein said clamp means includes anchor pins supported therefrom indexing said clamp and spacing and bracing body means relative to the rear end of said arm.

6. The implement of claim 1 including clamp means operatively associated with said arm, handle and resilient spacing and bracing body means clampingly securing said handle to said rear end of said arm.

7. A wood splitting implement for splitting log sections into firewood, said implement including an elongated horizontal handle having front and rear ends, a downwardly facing splitting head mounted on said front end, said head including a rear side projecting above and below said handle, a rigid arm rigidly supported from said rear side of said head, at an elevation spaced below said handle, against upward displacement relative to said head and projecting rearwardly from said rear side beneath said handle in closely spaced relation relative thereto, and resilient spacing and bracing body means spaced rearward of said rear side and interposed between the rear end of said arm and the opposing underside portion of said handle, clamp means operatively associated with said arm, handle and resilient spacing and bracing body means clampingly securing said handle to said rear end of said arm, the rear end of said arm including seat means defining an upwardly opening seat, said spacing and bracing body being seated in said seat, said spacing and bracing body means including indexing notch means in which portions of said seat means are received to index said spacing and bracing body means relative to said seat means.

8. The implement of claim 7 including an adjustable length strap-type clamp encircling said handle and said seat means.

9. The implement of claim 7 wherein said rear side of said head includes means defining an upstanding and downwardly opening dovetail guideway, said arm including a front end equipped with a dovetail enlargement thereon removably slidably received in said guideway.

10. A wood splitting implement for splitting log sections into firewood, said implement including an elongated horizontal handle having front and rear ends, a downwardly facing splitting head mounted on said front end, said head including a rear side projecting above and below said handle, a rigid arm rigidly supported from said rear side of said head, at an elevation spaced below said handle, against upward displacement relative to said head and projecting rearwardly from said rear side beneath said handle in closely spaced relation relative thereto, and resilient spacing and bracing body means spaced rearward of said rear side and interposed between the rear end of said arm and the opposing underside portion of said handle, said rear side of said head including means defining an upstanding and downwardly opening dovetail guideway, said arm including a front end equipped with a dovetail enlargement thereon removably slidably received in said guideway.

11. The implement of claim 10 wherein the rear end of said arm includes seat means defining an upwardly opening seat, said spacing and bracing body being seated in said seat.

* * * * *